US009206655B2

(12) United States Patent
Sipos

(10) Patent No.: US 9,206,655 B2
(45) Date of Patent: Dec. 8, 2015

(54) 360 DEGREE SHOULDER CLAMP ELEVATOR AND METHOD OF USE

(71) Applicant: David L. Sipos, Youngsville, LA (US)

(72) Inventor: David L. Sipos, Youngsville, LA (US)

( * ) Notice: Subject to any disclaimer, the term of this patent is extended or adjusted under 35 U.S.C. 154(b) by 36 days.

(21) Appl. No.: 14/214,493

(22) Filed: Mar. 14, 2014

(65) Prior Publication Data

US 2015/0259991 A1 Sep. 17, 2015

(51) Int. Cl.
*E21B 19/06* (2006.01)

(52) U.S. Cl.
CPC ..... *E21B 19/06* (2013.01)

(58) Field of Classification Search
CPC ..... E21B 19/06; E21B 19/02; E21B 19/00; E21B 19/07
USPC ..... 294/90, 194, 102.2
See application file for complete search history.

(56) References Cited

U.S. PATENT DOCUMENTS 1,716,905 A * 6/1929 Smith ..... 294/90
1,737,029 A * 11/1929 Shaffer ..... 294/90
2,109,493 A * 3/1938 Lundeen ..... 188/67
3,403,791 A * 10/1968 Brackin et al. ..... 414/22.51
4,441,749 A 4/1984 Blaschke et al.
5,340,182 A 8/1994 Busink et al.
6,494,273 B1 12/2002 Martin
6,568,479 B2 5/2003 Sipos et al.
6,915,868 B1 * 7/2005 Mosing et al. ..... 175/423
7,032,678 B2 4/2006 Mosing et al.
7,762,343 B2 7/2010 Sonneveld et al.
7,992,909 B2 8/2011 Bouligny, Jr. et al.
8,141,923 B2 3/2012 Bouligny et al.
8,146,671 B2 4/2012 Sipos
8,215,687 B2 * 7/2012 Pietras et al. ..... 294/203
8,267,450 B2 9/2012 Aarhus et al.
8,881,801 B2 * 11/2014 Marshall et al. ..... 166/85.1
2007/0228753 A1 * 10/2007 Dugal et al. ..... 294/88
2008/0150305 A1 * 6/2008 Hollin ..... 294/102.2
2010/0289285 A1 * 11/2010 Stoldt et al. ..... 294/88
2012/0326459 A1 * 12/2012 Angelle et al. ..... 294/90
2013/0284433 A1 * 10/2013 Weintraub et al. ..... 166/250.01

* cited by examiner

*Primary Examiner* — Gabriela Puig

(57) ABSTRACT

A self-balancing, shoulder type elevator is comprised of two opposing jaws pivotally connected to a hinge plate. The jaws are engaged for rotation at the hinge plate by corresponding sets of gear teeth. Hangers on said jaws attach the elevator to suspending bails. An offset alignment linkage pivotally attaches each jaw to the hinge plate and a rotatable spindles pivotally attached perpendicular to the jaws. The alignment linkage maintains the spindles angularly congruent in orientation with the bails when the opposing jaws are pivoted open and closed.

14 Claims, 8 Drawing Sheets

P
1
304
600
128

400
100

360 DEGREE SHOULDER CLAMP ELEVATOR AND METHOD OF USE

PRIORITY

This application claims priority to U.S. Provisional Application Ser. No. 61/782,570 filed Mar. 14, 2013 for 360 Degree Shoulder Clamp Elevator and Method of Use, the entire content of which is incorporated by reference.

FIELD OF INVENTION

This invention relates to oil well casing and drill string handling devices typically referred to as elevators. More particularly, it relates to an improved, articulated centrally mounted shoulder type elevator which retains proper balance and remains level in the open position

BACKGROUND

Drilling an oil and gas well with a conventional rotary drilling rig requires an elevator and a spider arranged in alignment with an opening in the rig rotary table are used in tandem to add and remove segments or joints of threaded tubing pipe, such as drill pipe or casing pipe, to the long strings of pipe placed in the wellbore. The spider is mounted within or over the rotary table of the drilling rig and the elevator is suspended above the spider on the hangers by bails attached to a hoist mounted on the drilling rig. The elevator and spider in combination are used to lift, hold, and release the pipe segments.

The pipe segments have collars that extend radially around the pipe periphery that with internal connecting threads used to connect the pipe segments together to form the pipe string. The collars have annular surface called a shoulder at the base of the radially collar. Elevators that support the pipe string on this shoulder are called shoulder elevator. Shoulder elevators often support pipe strings that weigh hundreds of tons and that great weight puts substantial stress, strain, and fatigue on the elevator and its components during use.

Shoulder elevators often have a static open ring used for receiving the tubular and supporting the tubular on the collar. Often these open rings have a door or doors that close around the tubular. Some elevators employ pivoting jaws where the elevator hangers are supported on bails that are suspended from a hoist. The jaws and hangers cause these elevators to cant or tilt even when no loads are being support or when the jaws are being opened to release a tubular.

Current shoulder elevators have many shortcomings that often lead to an eccentrically supported tubular that gives a pronounced cant or tilt to the elevator and the tubular being lifted. The elevator doors of shoulder elevators are prone to failure because of inadequate door design or because the elevator does not provide complete contact and support around the full circumference of the tubular collar. Elevators with hangers on pivoting jaws pivot on the hangers and move outwardly as the jaws are opened to receive a pipe. The outward movement shifts the center of gravity of the elevator causing the elevator jaws to sag when not attached to a pipe and require additional effort to level the elevator when receiving a pipe. A tubular collar not fully supported increases the likelihood of eccentric loading and the likelihood that the tubular will be shifted towards the ring opening or door. This shifting increases the risk of door failure and limits the maximum load which the elevator can safely handle. Any elevator failure will suspend drilling operations and may cause a lost or dropped pipe creating a significant risk property damage and personal injury.

Current elevators also suffer from lack of versatility as they are often sized for pipe having a specific diameter. Typically different elevators must be used when drilling operation require a change in tubular diameters, such as when a change is made between casing sizes. The lack of versatility requires drilling companies to maintain differently sized elevators on site and increases rig time and the drilling cost.

SUMMARY OF THE INVENTION

A 360 degree rotating shoulder type elevator is disclosed to address shortcomings associated with traditional shoulder elevators. The disclosed elevator has a pair of fully rotatable semi-circular jaws, a pair of aligning links, a pair of hanger spindles, a latching mechanism, and interchangeable bushings which allow the elevator to securely lift and support pipe of varying size.

The semi-circular jaws are configured such that two jaws combine to form a circular support structure that encircles the tubular and firmly bears on the entire tubular collar. To ensure a secure fit for varying sizes of pipe, each jaw houses a detachable bushing that may be selected to accommodate pipe of a predetermined diameter. The bushings are easily removed and replaced. A groove located within the jaw and mounting pins allow bushings to be slidingly engaged, detached, and replaced while maintaining the concentricity of the elevator. Bushing of variety of sizes may be provided to adapt the elevator to accommodate a large range of pipe diameters.

Each jaw is attached at one end to a pivoting hinge plate with the other end provided with corresponding latching components. The jaws are pivoted open and pivoted closed with respect to each other by a hydraulic piston assembly. Alternatively, the jaws can be manually opened and closed by a rig worker. Each jay has a centrally located spindle which allows the elevator to hang from an attached bail.

The elevator is intended for use with pipe having shouldered connection collars. When closed, the jaws are designed to encircle the pipe periphery below the connection collar. As the elevator is raised, the pipe collar shoulder contacts the jaws and the pipe lifts. When lifted the elevators jaws lift the pipe by providing complete contact and support to the tubular collar around the full circumference of the collar base.

When the pipe joint has been stabbed into the top of a preceding pipe joint in the pipe string, the jaws are opened away from the pipe circumference. This allows the pipe joint to be rotated freely with minimal drag.

DESCRIPTION OF THE DRAWINGS

FIGS. 8A to 10B show sequential views of the elevator of FIG. 1 illustrating the manner in which a pipe is gripped and lifted by the elevator.

DETAILED DESCRIPTION OF THE INVENTION

Figure 1:
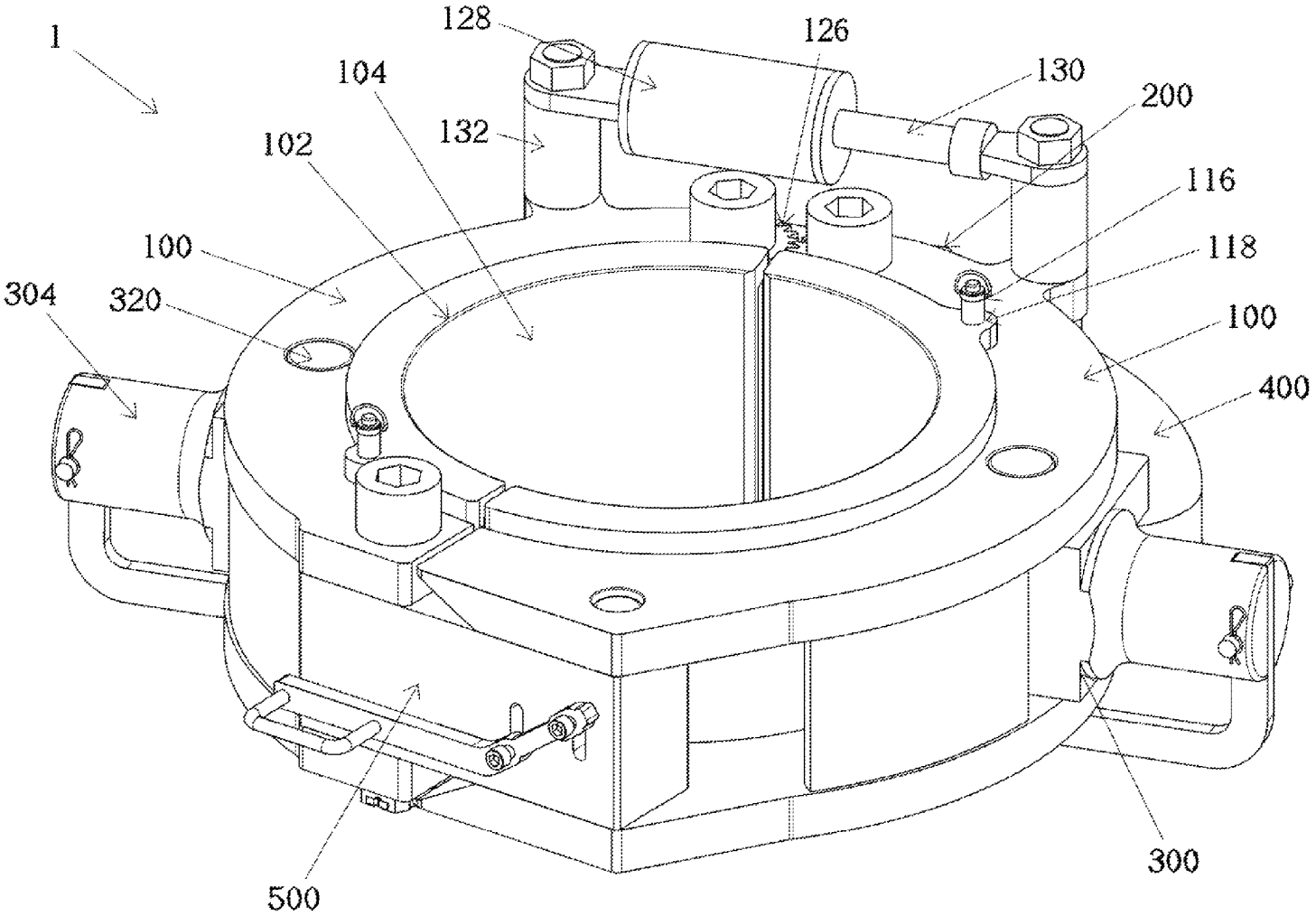
FIG. 1 is a perspective front view of the Applicant's hydraulically powered elevator in the closed position.

Unless otherwise specified, the illustrated embodiments can be understood as providing exemplary features of varying detail of certain embodiments, and therefore, unless otherwise specified, features, components, elements, and/or aspects of the drawings can be otherwise combined, interconnected, sequenced, separated, interchanged, positioned, and/or rearranged without materially departing from the disclosed invention. Elements illustrated in the drawings are provided primarily to facilitate understanding of the disclosed technology and may not be drawn to scale or with precise accuracy.

FIGS. 1-4, illustrate the elevator assembly (1) of applicant's invention. The elevator assembly is comprised of a pair of C-shaped jaws (100) pivotally engaged with a rear hinge plate (200). The jaws (100) pivotally combine to form an O-shaped ring with an interior surface (102). Each jaw is provided with a removable split bushing (104) that may be slidingly attached and detached from each jaw 100). The removable bushings can be replaced with bushings of a different size while maintaining the concentricity of the elevator (1).

The split bushings (104) can be made from the same material as the jaws (100) or some other material readily recognizable in the art.

Split bushings (104) are interchangeable and plurality of bushings (104) in a range of desired thicknesses may be provided to readily adapt the elevator (1) to receive and support a pipe (P) of a desired diameter. The split bushings (104) are supported on the jaws (100) and are removable from the jaws (100) by extraction of removable pin (116) inserted into a receiving hole (118) in the split bushing (104). Removal of pin (116) from the receiving hole (118) allows each split bushing (104) to be slidably disengaged from jaw (100) along interior jay surface (102) and replaced with another bushing (104) having the same or different thickness as desired.

Jaws (100) are opened and closed around hinge plate (200) by means of a rear hydraulic cylinder (128) and piston rod (130) affixed between posts (132, 136). The posts (132, 136) are positioned at the rear of each jaw (100). As the rod (130) is extracted from the cylinder (128) the jaws (100) are urged outwardly open for receiving a pipe (P). Retraction of rod (130) into the cylinder (128) urges the jaws (100) closed for clamping jaws (100) securely around a pipe (P). A latching mechanism (500) attached to the jaws (100) opposite the hinge plate (200) securely locks the jaws (100) together around the pipe (P). When jaws (100) are in the closed position, as illustrated in FIGS. 1 and 2, jaws (100) combine to form a continuous circumferential surface to engage and support a pipe (P) from below the pipe collar.

Figure 2:
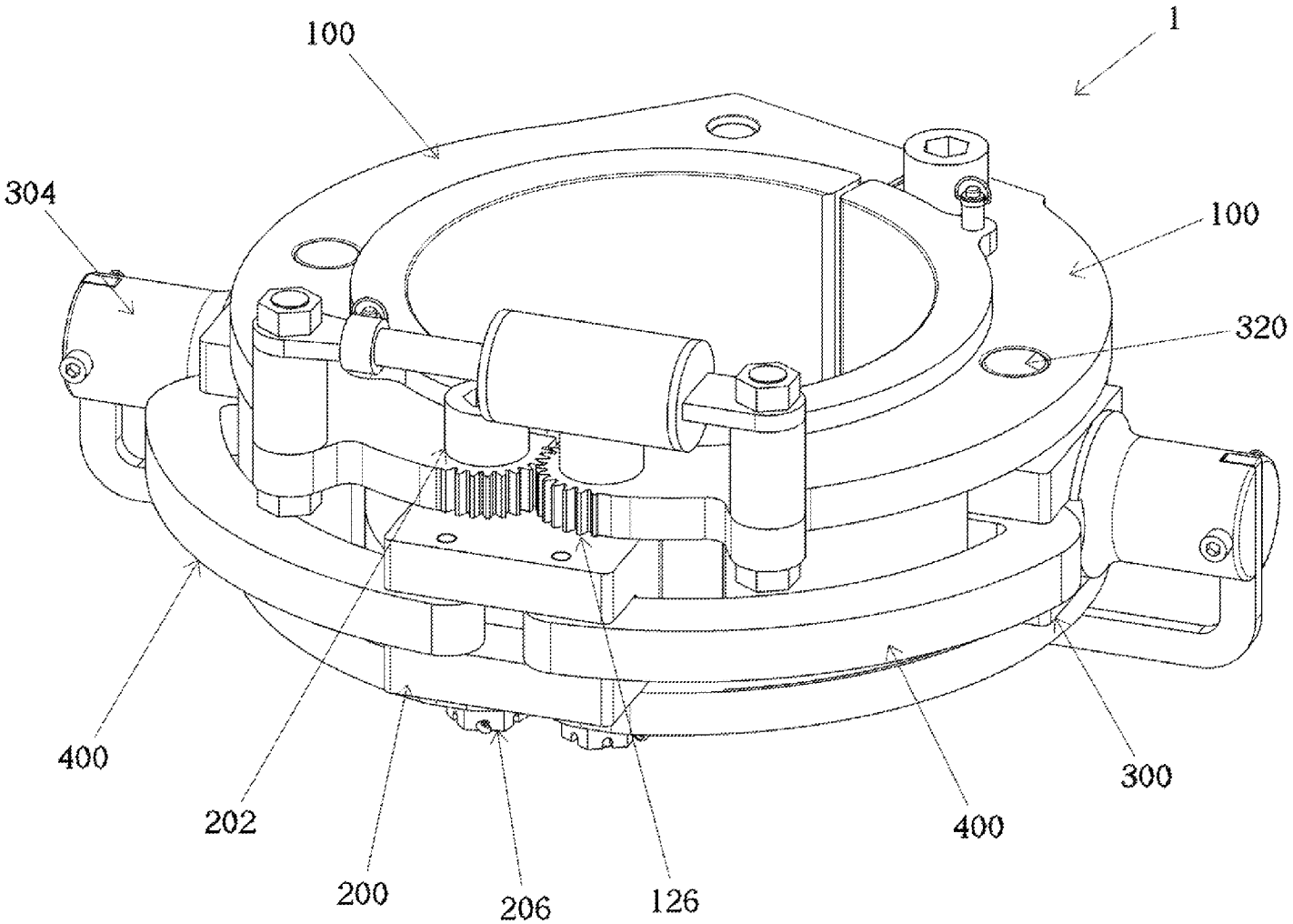
FIG. 2 is a perspective rear view of the elevator of FIG. 1 in the closed position.

FIG. 2 illustrates a rear perspective view of the elevator (1) in the closed position. A spindle (300) is pivotally attached to each jaw (100) with a pin (320). Each spindle (300) has a hanger (304) that extends outward from the jaws (100) to engage with the eyelets of a hanging bail. The hangers (304) are centrally positioned along the elevator's center of gravity to ensure that the elevator (1) maintains proper weight distribution during operation to prevent sagging of the elevator (1) and improper pipe alignment. An aligning link (400) is pivotally engaged to the rear hinge plate (200) and each spindle (300). The each aligning link (400) extends between the hinge plate (200) and spindles (300). As the jaws (100) are urged open or closed around the hinge plate (200) the aligning links (400) rotate the spindles (300) around pins (320) to maintain hangers (304) in congruent angular orientation relative to the eyelets of the hanging bails and the hinge plate (200).

Each jaw (100) has a plurality of gear teeth (126) that interconnect when the jaws (100) are connected to the hinge plate (200). A pin (202) and hex nut (206) positioned at an offset from the center of rotation of the teeth (126) and connects aligning link (400) between hinge plate (200) and a corresponding spindle (300). Once gear teeth (126) are aligned, the gear teeth (126) translate any rotational force applied to a first jaw (100) to the second jaw (100) and facilitate even rotation of jaws (100) relative to the hinge plate (200).

When one jaw (100) is rotatably urged open the second jaw (100) rotates an equal angular distance outward relative to the hinge plate (200). This outward rotation then pivots aligning links (400) about pin (202) which serves to rotate spindles (300) around pins (320) to maintain hangers (304) in congruent angular orientation relative to the eyelets of the hanging bails and the hinge plate (200). Aligning link (400) provides a means to pivot the spindle (300) during opening and closing of the elevator (1). As the jaws (100) of the elevator (1) open the aligning link (400) rotatably urges the spindles (300) relative to the jaws (100). A parallelogram formed between the jaws (100), hinge plate (200), spindle (300), and aligning link (400) causes the rotation of the spindles (300) to negatively mirror the rotation of the jaws.

As the angle formed in the parallelogram at pin (202) decreases during the opening of the elevator (1), the resulting angle at pin (320) decreases by an equal amount. Similarly, as the angle formed at pin (208) increases during the opening of the elevator, the resulting angle at pin (324) increases by an equal amount. Because supplementary angles must always combine to 180 degrees, as jaws (100) pivot around pin (202), the angles formed at pins (208) and (324) will always combine to 180 degrees. Similarly, the angles formed at pins (202) and (320) will always combine to 180 degrees. Consequently, the spindle (300) will maintain angular congruency with hinge plate (200) during opening and closing of the elevator (1).

Figure 3:
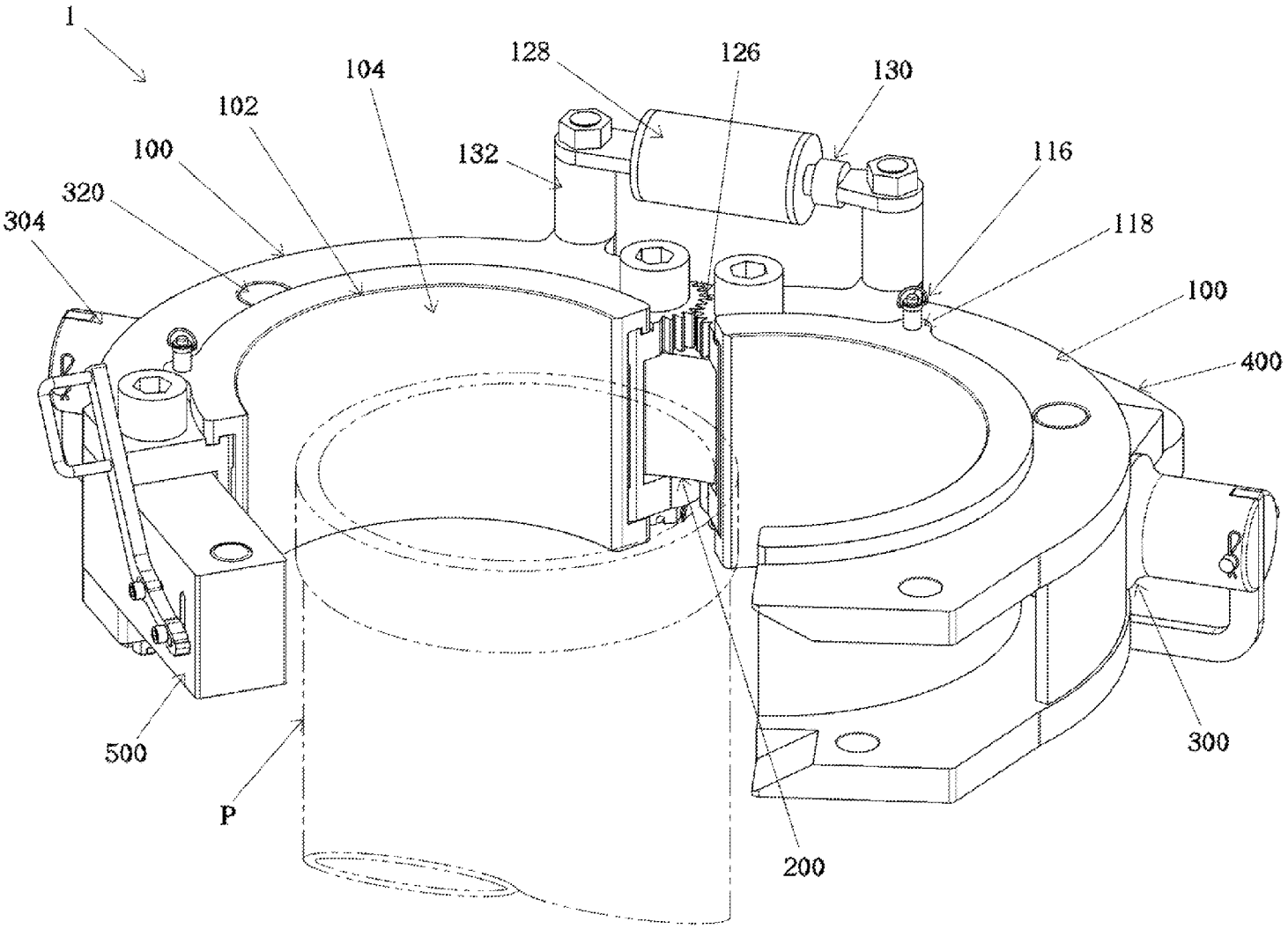
FIG. 3 is a perspective front view of the elevator of FIG. 1 in the open position.

FIG. 3 illustrates a front perspective view of the elevator (1) in the open position. When in the open position the elevator assembly (1) can receive a pipe (P) between jaws (100).

Figure 4:
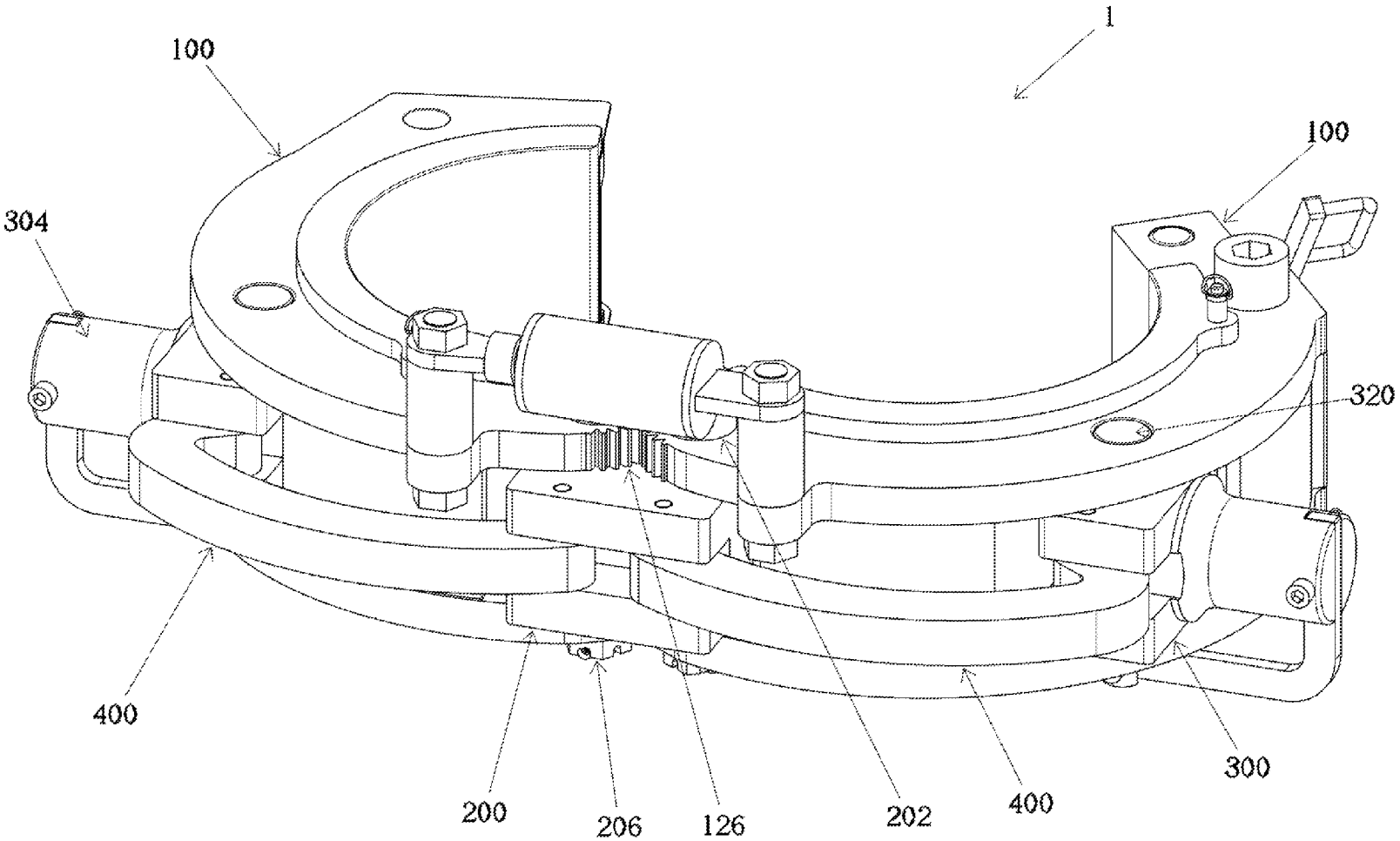
FIG. 4 is a perspective rear view of the elevator of FIG. 1 in the open position.

FIG. 4 illustrates a rear perspective view of the elevator (1) in the open position. As the jaws (100) translate open the aligning links (400) cause spindles (300) to rotate around pins (320). This rotation allows the spindles (300) to maintain angular congruency with the hinge plate (200) during the opening and closing of the elevator (1), facilitating proper balance of the elevator (1).

Figure 5:
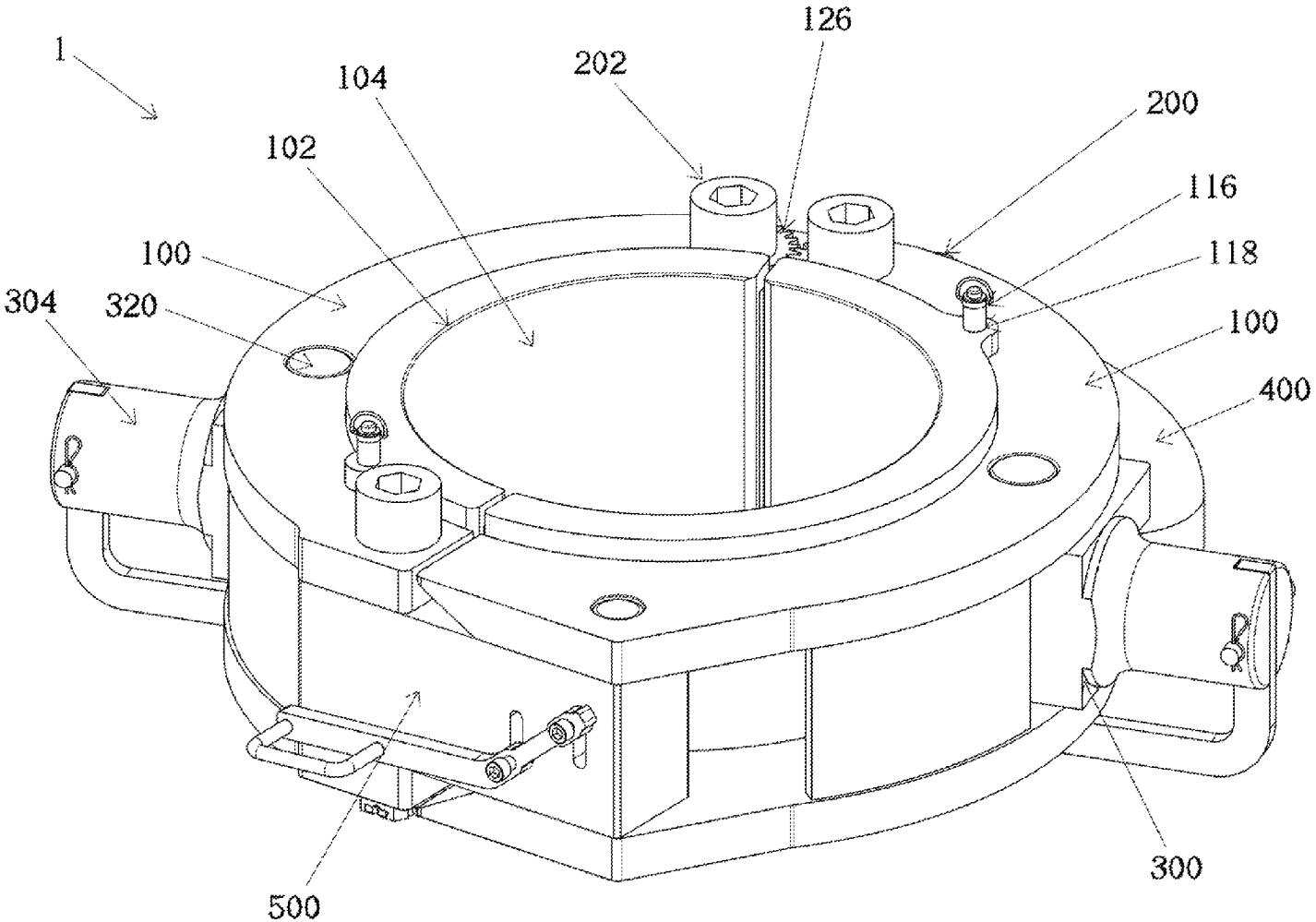
FIG. 5 is a perspective front view of an alternative embodiment of the elevator of FIG. 1 configured for manually operated jaws.

FIG. 5 illustrates an alternative embodiment of the elevator (1) wherein the jaws (100) are opened and closed manually. This alternative embodiment of the elevator (1) is substantially identical to the preferred embodiment disclosed in FIGS. 1-4 except for exclusion of the hydraulic cylinder (128) and rod (130) spanning posts (132, 136). In lieu of the hydraulic assembly, the latching mechanism (500) is manually operable where jaws (100) may be urged open and closed by a worker. It is believed that the manually operated version of the present invention sill cost less to produce and will be lighter because of the reduced number of components and attached hoses.

Figure 6:
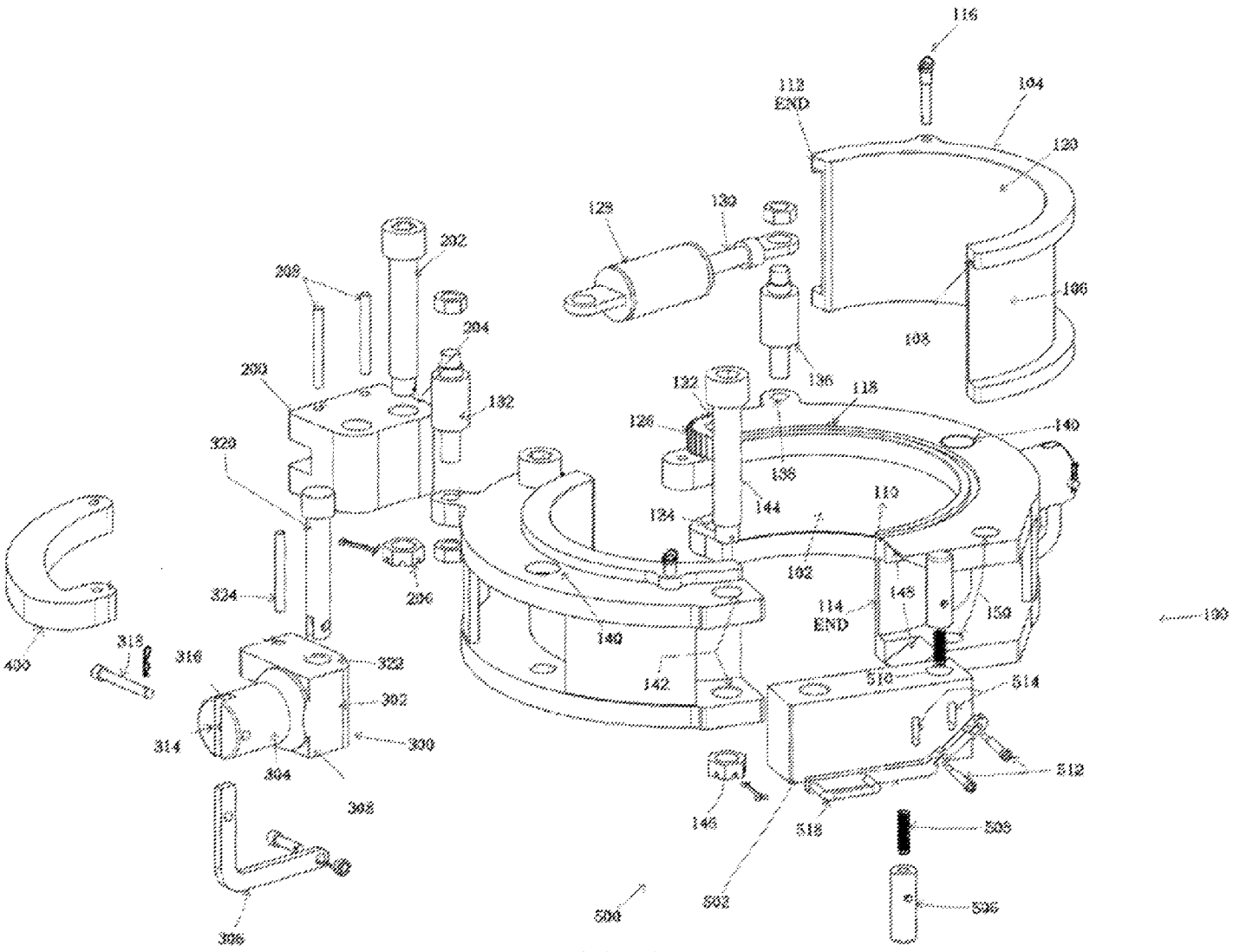
FIG. 6 is an exploded perspective view of the elevator of FIG. 1.

FIG. 6 is an exploded perspective view of the elevator (1). Positioned on each of the interior surfaces (102) of jaws (100) is a C-shaped split bushing (104). Split bushing (104) fittingly corresponds with the interior surface (102) of jaw (100) such that the outer surface (106) of each split bushing (104) sits flush with the interior surface (102) along its entire semi-circular C-shaped length.

Split bushings (104) engage with jaws (100) by means of a rail (110) and groove (108) linkage. The groove (108) of each bushing (104) aligns with the corresponding rail (110) of each jaw (100). As the groove (108) is urged onto the rail (110) the outer surface (106) of the bushing (104) slidably engages with the interior surface (102) of each jaw (100). Each bushing (104) is urged towards the jaw (100) until the end (112) of the bushing (104) rests flush with the end (114) of the jaw (100). This process is repeated for a second bushing (104) with the second jaw (100).

After the split bushings (104) are positioned and aligned within the jaws (100) a pin (116) is inserted through each split bushing (104) into a corresponding receiving slot (118) on each jaw (100). Pins (116) secure the split bushings (104) to the interior surface (102) of each jaw (100) and prevent the split bushings (104) from rotating during operation of the elevator (1).

Split bushings (104) create an interface between the jaws (100) and the outer diameter of a pipe (P) at inner surface (120). Split bushings (104) can be sized to various thicknesses and are interchangeable, allowing the elevator (1) to be customize for use with pipe (P) of various diameters. To facilitate interfacing with pipe (P) of varying diameter, a plurality of split bushings (104) sized in varying degrees of thickness may be provided as desired in order to adapt the elevator (1) for use with a variety of differently sized pipe.

Spindles (300) extend perpendicularly outward from each of the jaws (100) on either side of the elevator (1). Each spindle (300) is comprised of a body (302) having an outer surface (308), a cylindrical hanger (304) and an L-shaped shoulder (306). The hangers (304) extend perpendicularly outward from the outer surface (308) of the body (302) of the spindle (300). Hangers (304) rotatably engage with eyelets of a hanging bail. On a distal end (314) of each hanger (304) is a receiving slot (316). The L-shaped shoulder (306) securely engages within receiving slot (316) by means of a pin (318). The L-shaped shoulder (306) prevents the hanger (304) from slidingly disengaging from the eyelet of the hanging bail during operation of the elevator (1).

The spindles (300) are rotatably engaged with jaws (100) with a vertical pin (320). Pin (320) is inserted through a hole (322) in the spindle (300) and two holes (140, 140) in each jaw (100). This allows the jaws (100) to pivot around pins (202) while each hanger (304) maintains its original angular orientation relative to both the hinge plate (200) and the eyelets of the hanging bail. Without angular congruency between the hanger (304) and bail during opening and closing of the jaws (100) the hanger (304) would fail to sit flush with the eyelets and cause the elevator (1) to torque, which could cause damage to the engaged pipe (P).

Pins (202) are positioned within the central axis of the gear teeth (126) to facilitate rotation of the jaws (100). When a first jaw (100) is pivotally translated outwardly the second jaw (100) pivotally translates outward away from the first jaw (100). Similarly, when the first jaw (100) is pivotally translated inwardly the second jaw (100) pivotally translates inward towards the first jaw (100) to form a closed O-shaped ring.

Spindles (300) are centrally positioned on jaws (100) such that when the elevator (1) is in the open or closed position the central axis of each hanger (304) is aligned with the center of gravity of the elevator (1). As the jaws (100) are opened the spindles (300) pivot around the pins (320) allowing the spindles (300) to maintain angular congruency with both the hinge plate (200) and eyelets of the hanging bail.

The hinge plate (200) is located at the rear of elevator (1). Jaws (100) engage with hinge plate (200) by means of pins (202). Pins (202) traverse jaws (100) and hinge plate (200) through holes (122, 124, 204) to provide an axis of rotation for the jaws (100). Pins (202) are secured in place by hex nuts (206). It should be recognizable to one having ordinary skill in the art that any other contemplated means for securing pins (202) is acceptable.

Pins (202) are positioned within the central axis of the gear teeth (126) to facilitate rotation of the jaws (100). When a first jaw (100) is pivotally translated outwardly the second jaw (100) pivotally translates outward away from the first jaw (100). Similarly, when the first jaw (100) is pivotally translated inwardly the second jaw (100) pivotally translates inward towards the first jaw (100) to form a closed O-shaped ring.

Jaws (100) are opened and closed around hinge plate (200) and pins (202) by means of the hydraulic cylinder (128) and rod (130). The hydraulic cylinder (128) is mounted to post (132). The cylinder (128) is positioned radially outside of the interior surface (102) of the jaw (100). Cylinder rod (130) is mounted on a corresponding post (136) positioned at hole (138). Posts (132, 136) are positioned radially outward from interior surface (102) of the jaw (100) a sufficient distance to provide adequate clearance between the cylinder (128) and the outer surface of an engaged pipe (P). Failure to mount the hydraulic cylinder (128) and cylinder rod (130) sufficient distance from interior surface (102) would prevent the elevator (1) from closing around a pipe (P) as it would push the pipe (P) against the cylinder (128) and rod (130). This would cause the cylinder rod (130) to bend and rupture the seal necessary for the hydraulic cylinder (128) to operate effectively.

The jaws (100) of the elevator (1) are secured together by means of a latching mechanism (500) located opposite the hinge plate (200). Latching mechanism (500) is comprised of latching body (502), latch pin (506), and latching springs (508). The body (502) of the latching mechanism (500) is secured to a first jaw (100) at holes (142) with a pin (144) and a hex nut (146). Located within the body (502) are two vertically oriented cylindrical latch receiving bores (510) which do not fully traverse through the body (502). Slidingly fitted within each of the bores (510) is a latch pin (506). Latches (506) slide within bores (510) and are outwardly biased by latching springs (508). Pins (512) slide through openings (514) in the body (502) and attach to each of the latches (506). Pins (512) allow the latches (506) to slide within bores (510) while simultaneously preventing the latches (506) from disengaging therefrom. Each latch (506) can extend beyond the body (502) of the locking mechanism (500) a predetermined distance.

The maximum distance each latch (506) can extend outward from its bore (510) occurs when the pin (512) mounted to the latch (506) is slid to the end of its corresponding opening (514). Conversely, when the latching spring (508) is fully compressed within the bore (510) the latch (506) is fully retracted into the bore (506). A handle (518) attached between pins (512) external to the body (502) of the locking mechanism (500) allows leverage to be applied to the pins (512) to manually retract the pins (512) and latches (506) into the bores (510) and open jaws (100). For complete manual operation the hydraulic cylinder (128) and rod (130) spanning posts (132, 136) may be eliminated.

Body (502) is attached to a first jaw (100) with a pin (144). As the jaws (100) are urged together the locking mechanism (500) slidingly engages with a second jaw (100). The second jaw (100) contains two opposing angled surfaces (148). As latches (506) contact and are urged onto angled surfaces (148) the outwardly biased latches (506) compress latching springs (508) within the bores (510). The latches (506) retract into the bores (510) allowing the body (502) to slidably engage with the second jaw (100). As the body (502) is urged further into the second jaw (100) the latches (506) become aligned with latch receiving bores (150) on the second jaw (100). Latch receiving bores (150) traverse through the top and bottom surfaces of the second jaw (100) and are of a sufficient diameter to allow the latches (506) to slidingly engage therein. As latches (506) come into alignment with latch receiving bores (150), the outwardly biasing latching springs (508) cause latches (506) to extend into latch receiving bores (150). Once latches (506) are positioned within the receiving bores (150), the latching mechanism (500) is locked, and the jaws (100) are locked together in an O-shaped ring.

To open the latching mechanism (500) the pins (512) are translated across openings (514) until the latches (506) slidingly disengage from latch receiving bores (150) of the second jaw (100). Once latches (506) are fully translated from the latch receiving bores (150) the latching mechanism (500) can freely slide from the second jaw (100) at which point the jaws (100) can pivotally open around hinge plate (200).

To facilitate a center of gravity that aligns with the hangers (304) of spindles (300) and to offset the weight of rear hinge plate (200) and aligning links (400) the latching mechanism (500) can be weighted accordingly. Aligning the center of gravity along the hangers (304) facilitates smooth rotation of the elevator (1) around the bail eyelets and permits easier operation and handling of the elevator (1).

Figure 7:
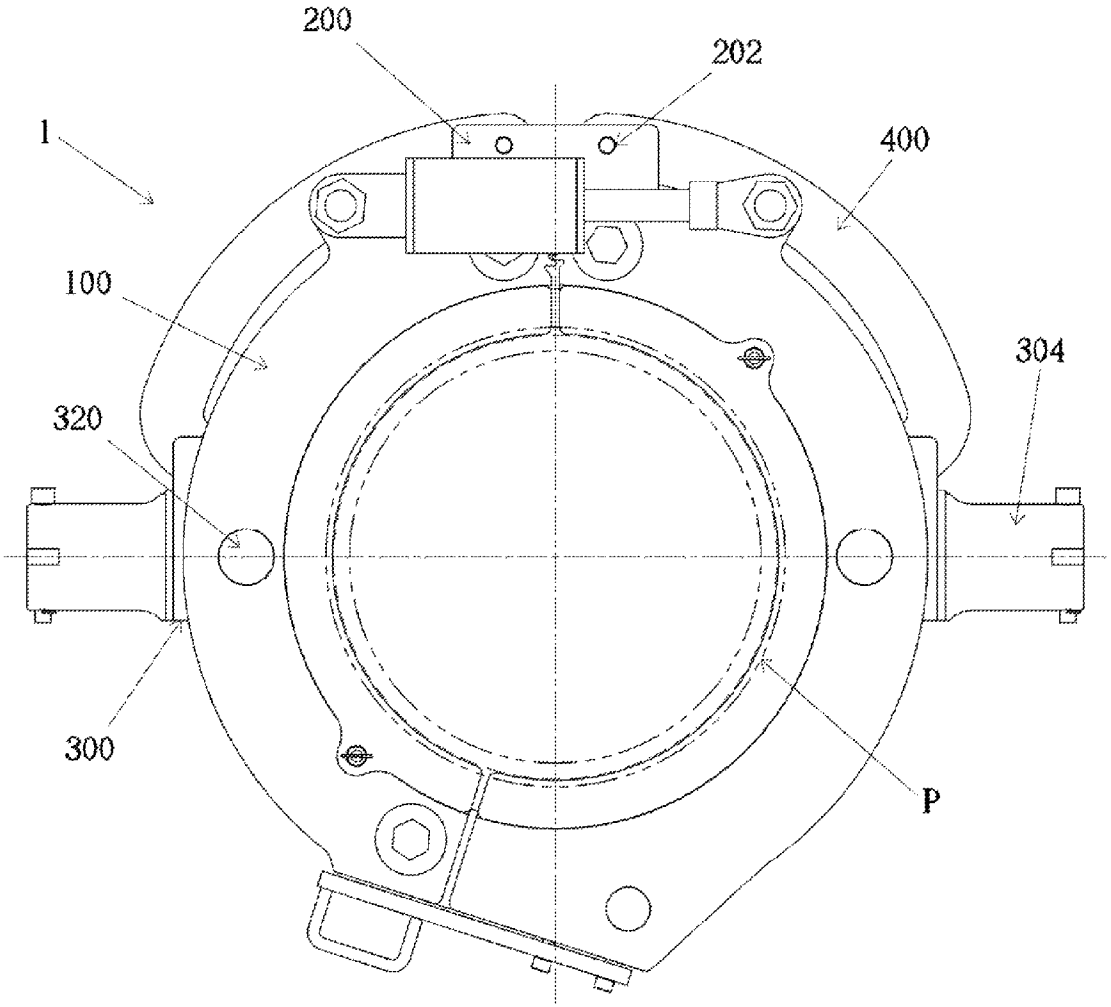
FIG. 7 is a top view of the elevator shown in FIG. 1 in the closed position.

FIG. 7 is a top view of the elevator (1) in the closed position. Hangers (304) extend perpendicularly outward from the elevator (1) to engage with the hanging bails of the travelling block of the oil rig. To prevent the elevator (1) from rolling, sagging, or spinning during operation, the elevator's center of gravity is located along the centerline of the hangers (304). In the closed position the elevator (1) is ready to lift and transport a pipe (P).

FIGS. 8A through 10B illustrate the process of opening and closing the jaws (100). As shown in FIGS. 8C and 9C, as the jaws (100) open the hangers (304) maintain continuous congruent angular orientation relative to the eyelets of a hanging bail (600) by means of the aligning link (400) and the Such angular congruency of the hangers and bail between hangers (304) and hinge plate (200) is maintained by means of the aligning link (400). The interaction of the aligning link (400) and the spindle (300) stabilizes the elevator (1) during operation, allowing the elevator (1) to remain level and properly balanced throughout opening and closing. Each aligning link (400) is shaped to fit around each jaw (100) and engage with the hinge plate (200) with spindles (300) to maintain angular congruency between the spindles (300) and the hinge plate (200).

Figures 8A, 8B, 8C, 9A, 9B, 9C, 10A, 10B:
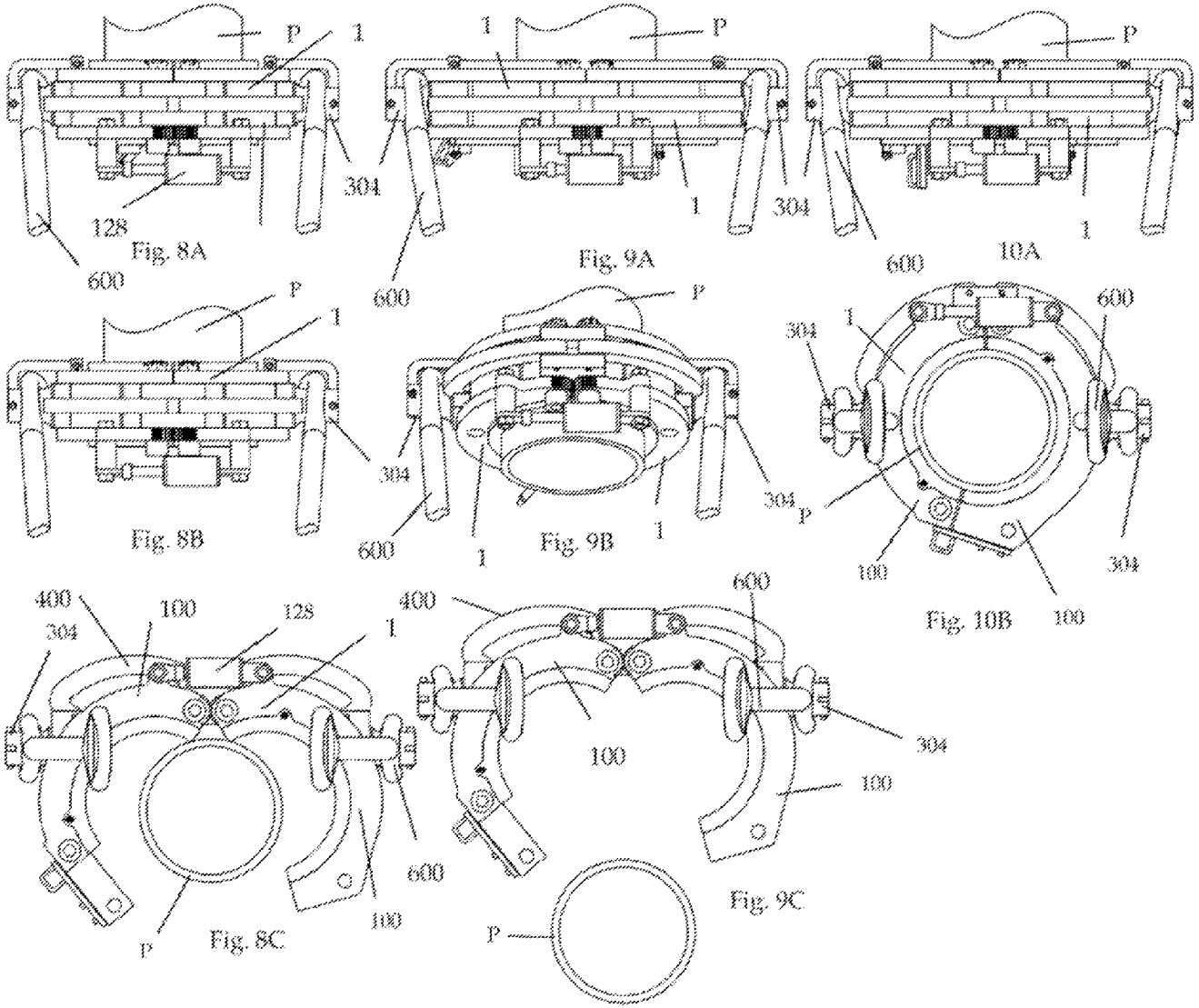

Angular congruency between the hangers (304), spindles (300) and hinge plate (200) during the opening and closing of the elevator (1) is best exemplified by the distal ends (314) of the hangers (304) remaining parallel in both the open positions shown in FIG. 8C and 9C and closed positions shown in FIG. 9A. FIGS. 8A, 9A and 10A are top views of the elevator (1) pivoted on hangers (304) to engage a pipe (P). FIGS. 89B 9, and 10B show a top view of the grabbing and lift sequence with the jaws open in FIG. 8A prior to pipe engagement, to an angled pipe (P) the lift progress, to a vertical pipe (P) shown in FIG. 10B.

I claim:

1. An elevator comprising:

(a) a pair of opposing semi-circular jaws, each said jaw having first and second ends;

(b) a set of gear teeth on said first end of each said jaw, said set of gear teeth rotatably connecting each said jaw;

(c) a hinge plate having first and second opposing hinge pins, said hinge pins pivotally attaching a said first end of one of said jaws to said hinge plate about the centerline of said set of gear teeth;

(d) a spindle pivotally attached to each said jaw;

(e) a radially extending hanger coincident with each said spindle; and (f) an aligning link pivotally connecting said second end of each said jaw to said attached jaw spindle; and (g) a pin offset from said axis of rotation of said gear teeth pivotally connecting each said aligning link to said hinge plate.

2. The elevator of claim 1 further comprising:

(a) cylinder and piston assembly pivotally connected between said opposing jaws;

(b) a latch releasably joining said second ends of said opposing jaws; and (c) said hanger extending outward from each of said opposing jaws.

3. The elevator of claim 2 further comprising a detachable busing releasable mounted on each of said opposing jaws.

4. The elevator of claim 3 pivotally attached to bails of a travelling block on a drilling rig.

5. A elevator comprising:

(a) two jaws, (b) a hinge plate, said jaws pivotally linked at a first end to said hinge plate;

(c) a means for locking said jaws at a second end;

(d) a spindle connected to each of said jaws;

(e) an alignment linkage pivotally attached between said hinge plate and spindle; and (f) whereby said alignment linkage maintains said spindles angularly congruent in orientation.

6. The elevator of claim 5, wherein each of said jaws is C-shaped semi-circular.

7. The elevator of claim 6, wherein each of said jaws has an internally positioned bushing, said bushing forming an intermediary linkage between said jaws and a tubular pipe.

8. The elevator of claim 7, wherein said bushing slidingly engages with said jaws.

9. The elevator of claim 8, further comprising an actuator, said actuator being configured to open and close said jaws around said pivoting first end of said jaws.

10. The elevator of claim 9, wherein said actuator comprises a hydraulic cylinder with a retractable and extendable cylinder rod, said hydraulic cylinder positioned on said jaws to translate linear force produced by said hydraulic cylinder into axial rotation of said jaws around a gear located on said jaws.

11. The elevator of claim 9, wherein said spindles rotatably engage with said jaws and remains in relative continuous perpendicular alignment with each other throughout operation.

12. The elevator of claim 11, wherein said spindles are located on said jaws such that when said jaws are connected at said first and said second ends said spindles traverse a central axis of said jaws.

13. The elevator of claim 12, wherein said alignment linkage is configured to maintain said first spindle angularly congruent with said second spindle while said jaws pivotally open and close around said hinge plate.

14. elevator of claim 5, wherein said first ends of said jaws contain a plurality of gear teeth rotatably coupling a first of said jaws with a second of said jaws.

* * * * *